US006155465A

United States Patent [19]

Steiger

[11] Patent Number: 6,155,465

[45] Date of Patent: Dec. 5, 2000

[54] DISPENSING DEVICE FOR A FLUID CONTAINER

[76] Inventor: Arthur Steiger, Alte Bergstrasse 168, CH-8707 Uetikon an See, Switzerland

[21] Appl. No.: 09/383,421

[22] Filed: Aug. 26, 1999

[30] Foreign Application Priority Data

Sep. 2, 1998 [DE] Germany ..... 198 39 842

[51] Int. Cl.[7] ..... B65D 35/38

[52] U.S. Cl. ..... 222/501; 222/531

[58] Field of Search ..... 222/501, 531, 222/559, 81, 105

[56] References Cited

U.S. PATENT DOCUMENTS 4,375,864 3/1983 Savage ..... 222/501 X 5,823,397 10/1998 Gil ..... 222/501 X

*Primary Examiner*—Kevin Shaver

*Assistant Examiner*—Thach Bui

*Attorney, Agent, or Firm*—Bachman & LaPointe, P.C.

[57] ABSTRACT

In a dispensing device for a fluid container of flexible material in an outer container which encloses it and which is substantially stable in respect of shape and through which the dispensing device extends, a tube connection of the dispensing device is fluid-tightly and gas-tightly connected to the wall of the fluid container in the region of a wall opening, by a flange collar formed on the tubular portion. Associated with the tube connection is a separate closure body which in the closure position closes the cross-section of the tube space and which is to be releasably fixed to the free tube mouth end of a connection tube which can be axially introduced into the tube space. The closure body can be transferred with the connection tube out of the closure position into an open position in which the closure body at the tube mouth end and at least one radial opening through the tube wall of the tube mouth end are arranged in the fluid container. The diameter of the cylindrical tube space of the tube connection is larger at the container side than at the other end, forming an annular shoulder.

18 Claims, 3 Drawing Sheets

Figure 1:
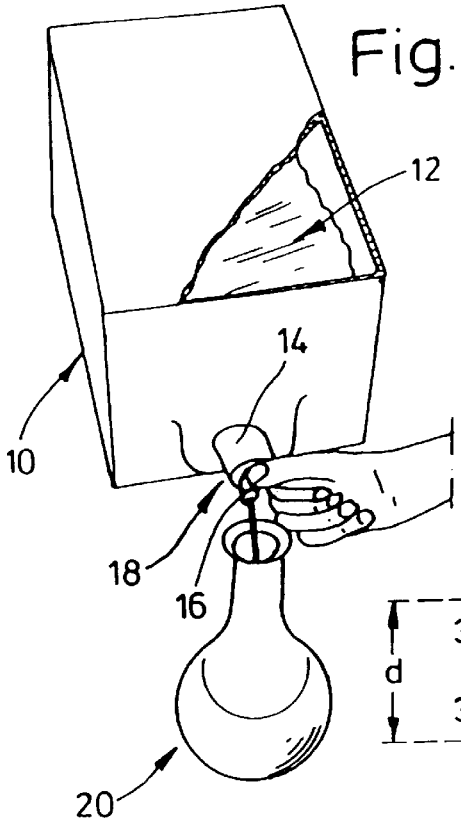

Fig.5
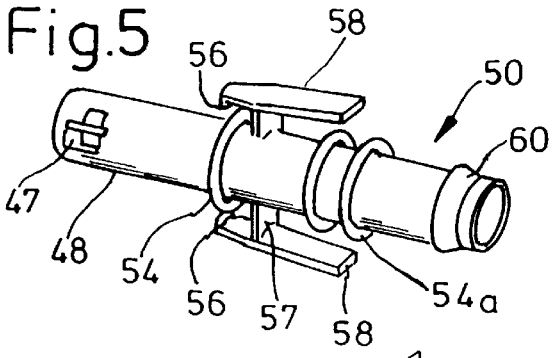
Fig.6
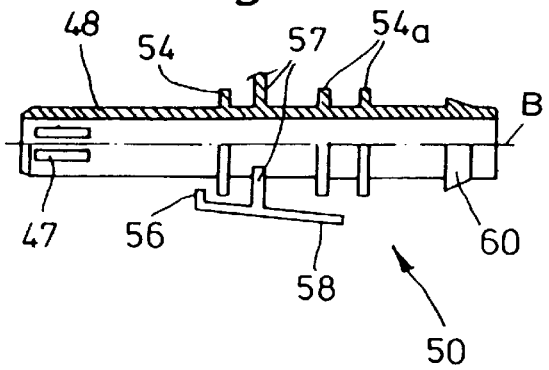
Fig.7
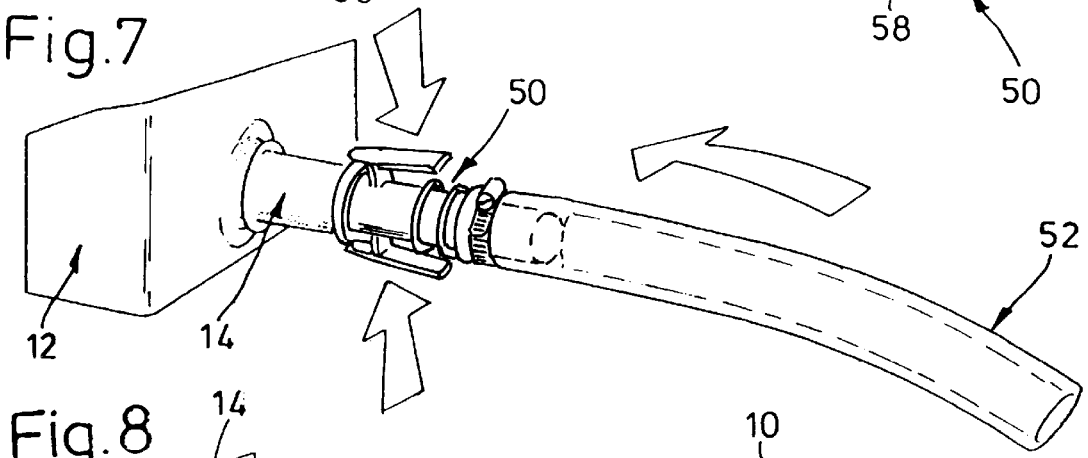
Fig.8
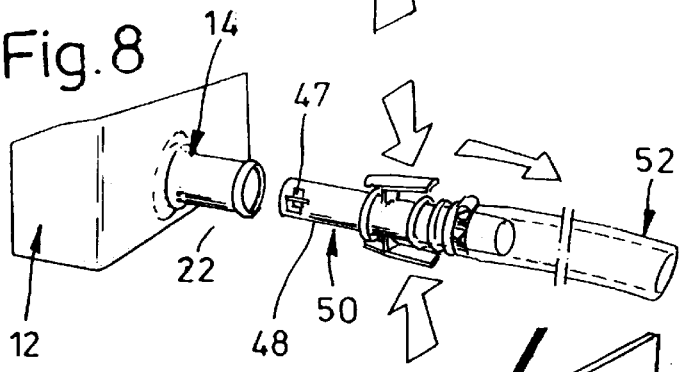
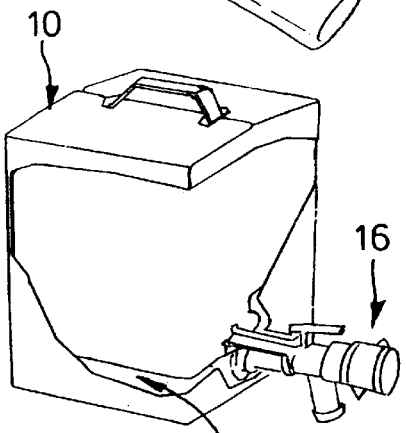
Fig.9
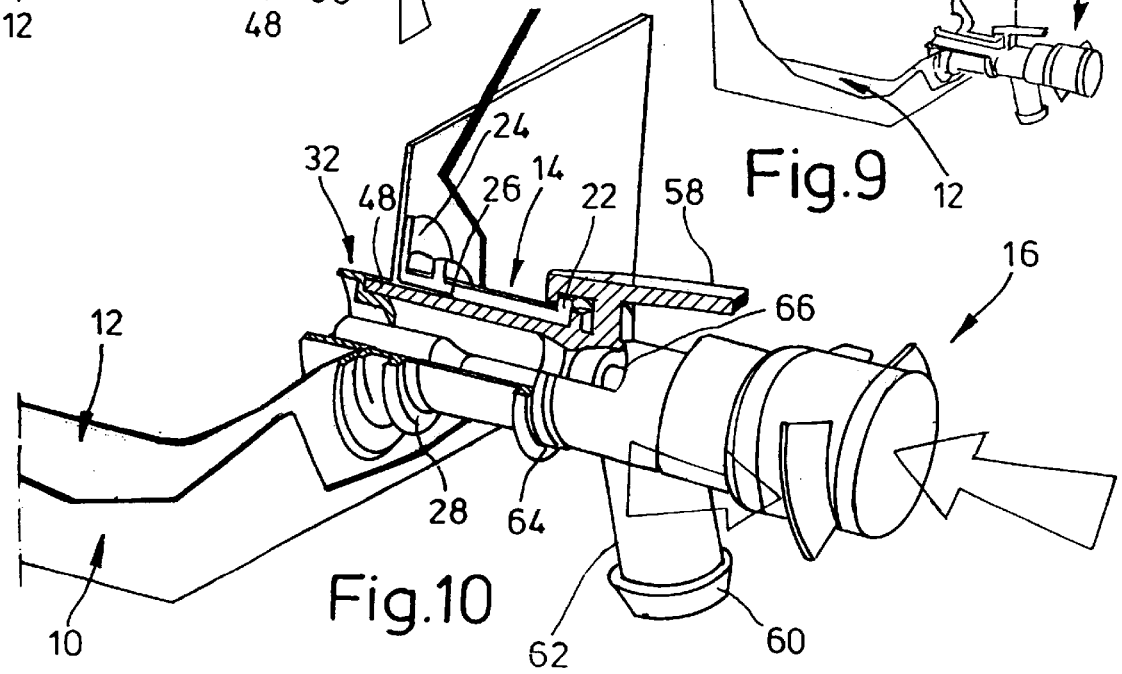
Fig.10

DISPENSING DEVICE FOR A FLUID CONTAINER

The invention concerns a dispensing device for a fluid container—in particular for a container comprising flexible material in an outer container which encloses it and which is substantially stable in respect of shape and through which the dispensing device passes—, wherein a tubular portion of the dispensing device is liquid-tightly and gas-tightly connected to the wall of the fluid container in the region of an opening through the wall—in particular by means of a flange collar which is formed on the tubular portion.

Arrangements comprising an outer container which is stable in respect of shape and an inner container which is supported therein and which comprises flexible material are known for storing fluid foods such as wine, cooking oil or the like. The for example cuboidal or parallelepipedic outer container can comprise corrugated cardboard and its inner container can be formed in a bag-like fashion from heat-welded plastic film. Systems of that kind are also referred as "bag-in-box" containers.

A flange collar of a hollow profile formed from plastic material can be fluid-tightly and gas-tightly welded in an opening in the inner container, to the latter. Usually a spigot or a faucet or cock is pressed into that hollow profile; while the spigot is withdrawn to dispense fluid, the re-closable faucet, for that purpose, includes a valve element which is associated with the cross-section of an outlet opening.

For transportation purposes the spigot or the faucet is disposed within the outer container and prior to opening is pulled through a pre-perforated portion of the outer container. In order in that respect to prevent unintentional actuation of the valve element the faucet can additionally be provided with a sealing means. When the fluid flows out the flexible inner container collapses, that is to say its volume always adapts to the amount of fluid contained therein—therefore oxidation phenomena due to air flowing into the container do not occur.

A point of significance in regard to faucets of that kind is the sealing integrity thereof in relation to the oxygen in the ambient atmosphere; if the oxygen in the atmosphere penetrate into the fluid container, fluid food stuffs, for example wine stored in the inner bag, suffers a considerable reduction in the period of time for which it keeps. The sealing integrity of a faucet made from plastic material obviously decreases in reciprocal relationship to the number of connecting locations provided therein.

The properties required of a faucet of the described kind, besides good flow speed for the material filling the container, are a capability of easily keeping it clean and a design configuration which is such as to facilitate injection molding.

Rotational elements are unsuitable for so-called bag-in-box systems as the flexible inner container does not afford sufficient resistance to rotational movement. To open such a faucet, the faucet or its coupling portion has to be held fast with the one hand while the valve element is operated with the other hand. A rotational faucet with a valve cover which is rotatable by hand its to be found for example in DE 39 10 425 A1. Better suitable for a bag-in-box system are faucets which can be opened and held at the same time with one hand; by virtue of that arrangement the second hand remains available for holding a vessel which is to be filled.

In order to keep the inner container free from oxygen prior to the first use of the container, the above-mentioned opening through the inner container can be closed by a plate or a stopper member which is removed prior to initial use.

There are also faucets which in addition to the valve element also involve a device for piercing the plate or for removing the stopper member from the opening through the container. In that case the valve element can be connected to the piercing device, in which respect attention is directed to DE 32 12 232 A1.

The latter describes a faucet with a valve element and closure device in which the valve element and a stopper member of the closure device are arranged coaxially one behind the other. Upon actuation of an elastic knob the valve element is removed from its valve seat; that causes opening of the faucet. At the same time the valve element urges the stopper member towards the outlet and the opening through the container is opened.

The dispensing devices previously provided for the bag-in-box systems are inter alia limited to an expensive design concept and to a respective kind of closure; changing from individual glass filling—in the case of drinks—to continual emptying is only possible at relatively great cost.

In consideration of that state of the art the object of the present invention is that of simplifying a dispensing device for fluid containers of that kind set forth in the opening part of this specification, in terms of structure and use. In addition the inventions seeks to provide that handleability is improved and multiple changes from a shut-off mode of operation with an outlet faucet on the one hand to continual operation with a hose or tube connection on the other hand are possible.

That object is attained by the teaching of the present invention.

In accordance with the invention associated with the tubular portion which is in the form of a tube connection is a separate closure body which in the closure position closes the cross-section of the space in the tube and which is to be releasably fixed to the free tube mouth end of a connecting tube which can be axially introduced into the space in the tube, which closure body can be transferred with said connecting tube from the closure position into an open position; in the latter the closure body disposed at the tube mouth end and at least one radial opening through the tube mouth end are so arranged in the fluid container that a through-flow path is opened for the fluid from its container into the connecting tube. In order to close the fluid container the closure body which is clampingly fixed on the tube mouth end is retracted with the connecting tube until it is again fitted in the tube connection.

In accordance with further features of the invention the cylindrical space in the tube connection is formed at the container end as a seat for the closure body by virtue of the fact that the diameter of said space in the tube, at the container end, is larger, forming an annular shoulder, than at the other end, and the closure body advantageously has a cylindrical ring which is adapted to the larger diameter of the space in the tube and the axis of which lies on the longitudinal axis of the tube connection in the closure position of the device; in that case the cylindrical ring or its annular edge remote from the container bears against the annular shoulder of the tube connection.

In order to provide for a releasable fit of the closure body which is closed in accordance with the invention within its cylindrical ring, on the tube mouth end, the cylindrical ring is to have an annular groove, the cross-sectional shape of which corresponds to that of the tube mouth end. If in addition the width of the annular groove is equal to the thickness of the tubular wall of the tube mouth end, that ensures a good fit.

The closure body is preferably closed by a radial plate with a cup-like or hat-like central outward enlargement portion adjoining the cylindrical ring at the inward side; the outside surface of the enlargement portion, which is parallel to the axis, delimits the annular groove on the inside. Shaped ribs which are parallel to the axis can project from said outside surface and/or the inside surface of the cylindrical ring, to improve the plug-in connection between the tube mouth end and the closure body.

It has been found desirable for an axial pin to be formed on the closure body or its cup-like or hat-like central enlargement portion, the axial pin projecting coaxially into the space in the tube as a guide means for the tube mouth end; upon insertion into the tube connection which is closed by the closure body, the tube mouth end is guided by the axial pin with its preferably conically enlarging transition to the hat-like central enlargement portion, towards the annular groove.

Usually polyethylene is selected as the material for the tube connection. In comparison therewith, in accordance with the invention the closure body is formed from a harder plastic material, preferably polypropylene; this pairing ensures a particularly close and sealing coupling fit.

The tube connection which advantageously has a respective radial flange collar at each of its two ends, in a particular configuration, is also to provide an additional annular flange on its tube connection at the receiving portion for the closure body in the proximity of the annular shoulder.

As regards the radial opening in the tube wall of the tube mouth end, it adjoins the clamping region thereof—preferably in the form of a slot parallel to the axis; when the closure body is connected that clamping region is fitted in the annular groove thereof.

In order to be able to reliably connect the tube connection to the tube mouth end, the latter is preferably provided with at least one pressure rocker member which is disposed at a spacing relative to its outside surface and which is adapted to be tiltable relative to said surface and which is formed towards the free edge of the tube mouth end with a retaining or detent rib which is approximately radially directed with respect to the longitudinal axis of the tube mouth end in a hook-like configuration; that retaining rib—or the plurality thereof—engages in the open position of the coupled pairing comprising the tube mouth end and the tube connection behind the flange collar thereof remote from the container. In order to retract the tube mouth end, that is to say to close the tube connection towards the container, the pressure rocker member must be intentionally released from the flange collar.

In accordance with the invention the tube mouth end is to be part of a faucet with locking device or part of a general or universal connecting tube for a hose.

While the connecting tube is general or universal for the hose, the faucet, at a tube portion which axially extends the tube mouth end, has a lateral outlet connection and, as a locking device, a sealing disc which closes its cross-section and which is axially displaceable and which in the sealing position of the connection mouth is moved towards the container and is returned by way of same on an axial bar into an outlet position.

Overall this arrangement affords a system which is simple to produce and extremely reliable in operation for a "bag-in-box" container with interchangeable dispensing accessory.

Figure 2:
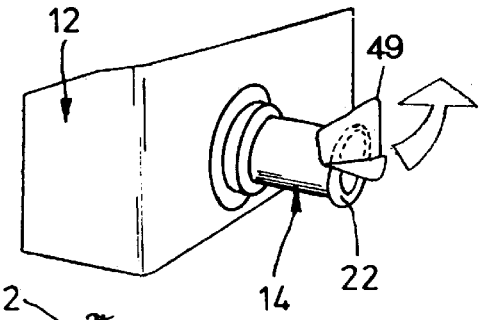
Figure 3:
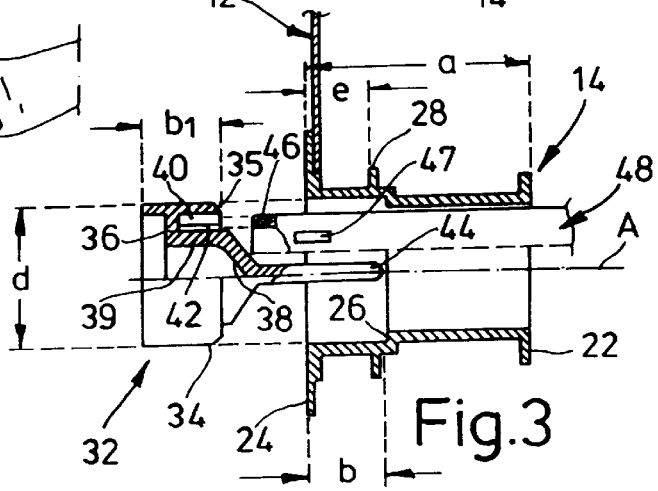
Figure 4:
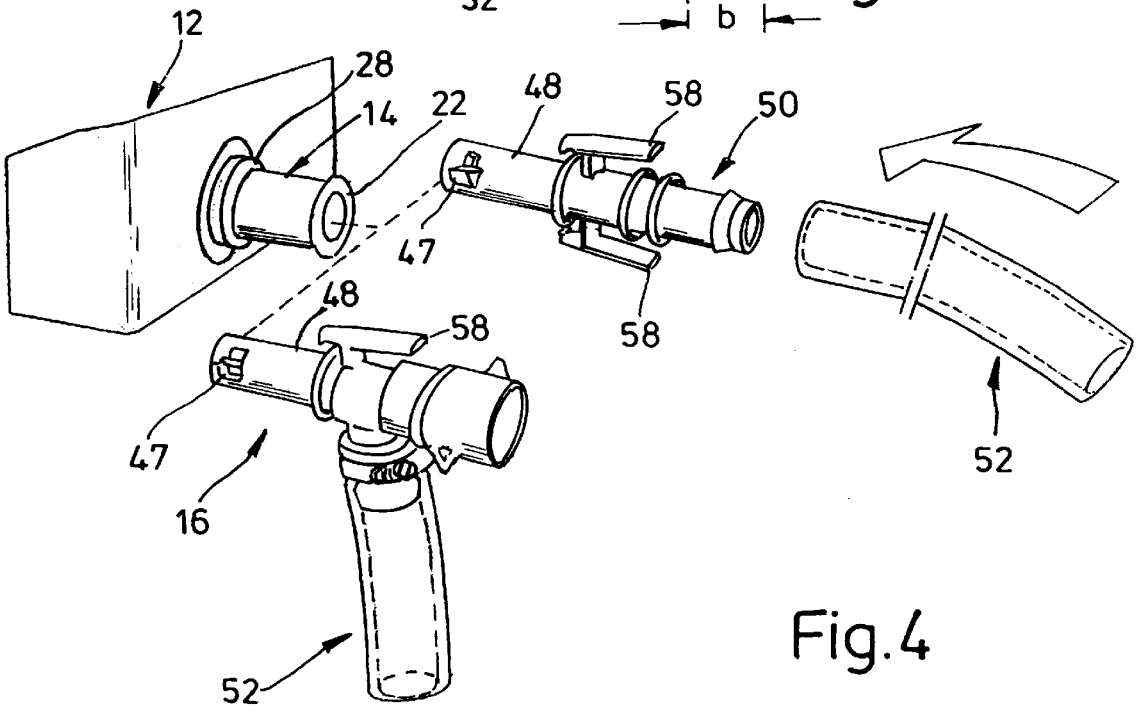
Figure 11:
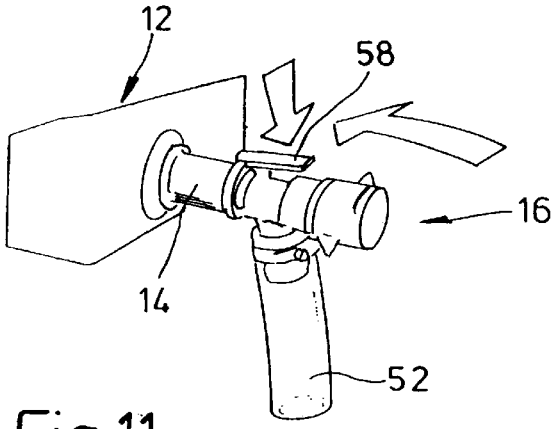
Figure 12:
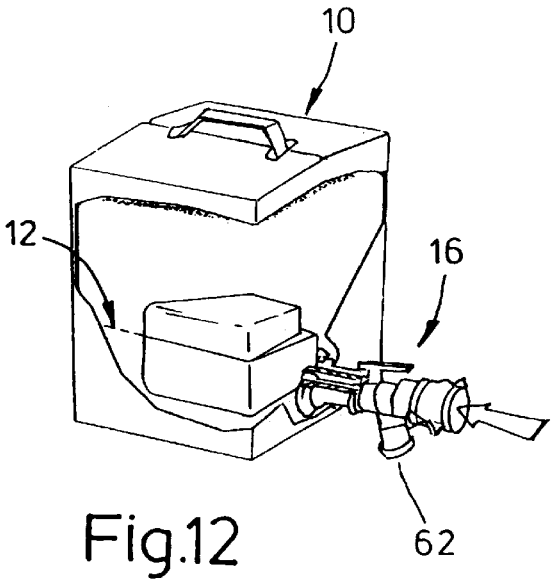
Figure 13:
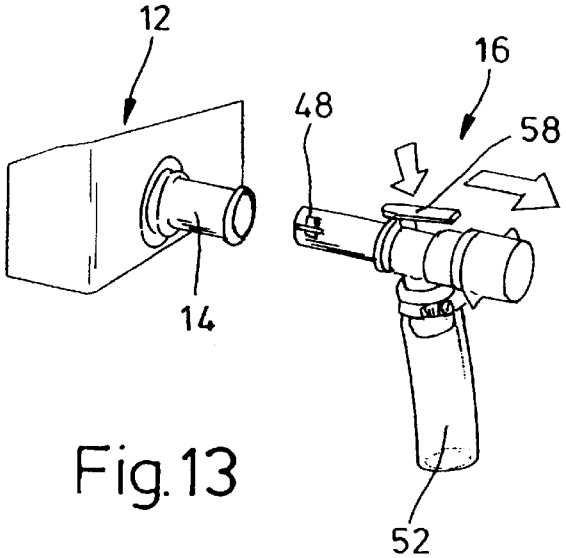
Figure 14:
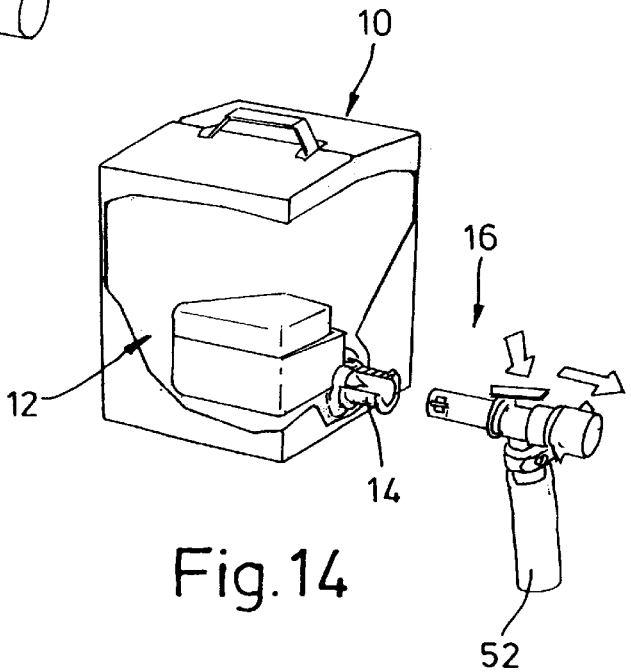

Further advantages, features and details of the invention will be apparent from the following description of preferred embodiments and with reference to the drawings in which:

FIG. 1 is a perspective view of a so-called bag-in-box container for a fluid with a plastic faucet for emptying the container, FIGS. 2 and 4 are views on an enlarged scale showing details from FIG. 1 with a connecting portion of the plastic faucet, FIG. 3 is a view on an enlarged scale in longitudinal section through the connecting portion, FIG. 4 shows a perspective view of the connecting portion with two connecting elements which are to be alternatively mounted thereto, in the form of a hose connection and an outlet faucet, FIG. 5 is a perspective view on an enlarged scale of the hose connection tube, FIG. 6 is a partly sectional side view of the hose connection tube, FIGS. 7 and 8 each show a perspective view of the hose connection tube during its fixing and its removal respectively, FIG. 9 is a perspective view of a partially sectioned container with inserted outlet faucet, FIG. 10 is a portion on an enlarged scale from FIG. 9, FIGS. 11 and 12 show two different views of the outlet faucet during fixing thereof, and FIGS. 13 and 14 show two different illustrations of the outlet faucet during removal thereof.

Disposed in a cuboidal outer or packaging container 10 which is made from corrugated card or the like is a fluid container which is only indicated at 12 and which is of a baglike nature, comprising heat-welded plastic film with an outer covering of an aluminum layer. This flexible inner or fluid container 12 is provided in the region of an opening therethrough with a tube connection 14 which passes through the packaging container 10 and which for example with a cock or faucet 16 which can be actuated by hand, forms a dispensing device 18 for the fluid container 12; the dispensing device can be used for example to fill a wine carafe 20 with the content of the container. It will be appreciated that this so-called "bag-in-box" may also contain industrial fluid or the like.

The tube connection 14 of a length a by way of example of 35 mm and with a longitudinal axis A is provided at each of its two ends with a respective flange collar 22, 24 and at a spacing b—of 12 mm in this case—from the outside surface of the inner flange collar 24 serving as a closure element, with an annular shoulder 26 which reduces the tube diameter d from 20 mm in stepped configuration to 16 mm. At a shorter spacing e from the outside surface of the inner flange collar 24, an annular flange 28 projects from the tube connection 14. In FIG. 3 its inner flange collar 24 is welded to the wall 13 of the fluid container 12 through which it passes.

Associated with the tube space 30 of the tube connection 14 which is formed from a softer plastic material—for example polyethylene—is a closure body 32 which can be inserted on the inner flange collar 24. When the closure body 32 is pushed into the tube space 30 in the direction indicated by the arrow x, a cylindrical ring 34 of the closure body 32 bears closely against the inside surface of the tube and the front edge 35 of the cylindrical ring 34 of the axial length $b_1$ bears against the annular shoulder 26.

Formed on the cylindrical ring 34 at the inside is a radial plate 36 and formed thereon is a central hat-shaped portion 38 with an annular wall section. The latter, with the cylindrical ring 34, defines an annular groove 40. A tube mouth end 48, provided in its tube wall 46 with wall openings 47, of the faucet 16—or a hose connection tube 50 shown inter alia in FIG. 4—can be inserted into the annular groove 40, in opposite relationship to the so-called pull-in direction x, in such a way that the closure body 32 is held clampingly to the tube mouth end 48—closing same—; the thickness q of the tube wall 46 (see FIG. 6) corresponds to the width of the annular groove or the annular gap 40, into which additionally project shaped ribs 42 of the annular wall section 39 as clamping aids.

For the purposes of guiding the tube end 48 which is searching for the annular groove 40, an axial pin 44 of the closure body 32, which lies on the longitudinal axis A of the unit consisting of the tube connection 14 and the closure body 32, projects from the hat-shaped portion 38.

When the closure body 32 which is formed from a harder plastic material such as polypropylene is fitted in the tube space 30 of larger diameter d, which is delimited by the annular shoulder 26, then the tube space 30—and therewith the fluid container 12—are sealed off. If the faucet 16 is to be connected, its tube mouth end 48—after release of a seal 49 covering it over—is pushed into the tube connection 14 from the outer flange collar 22 until the free edge of the tube mouth end 48 is in the annular gap 40 of the closure body 32 and pushes it out of the closure position—in the opposite direction to the direction of the arrow x—into the fluid container 12. The content thereof now flows through the described wall openings 47 into the tube mouth end 48.

If the fluid container 12 is to be closed again, the closure body 32 is retracted in the pull-in direction x into the tube space 30 of larger diameter d until it bears against the annular shoulder 26. The faucet 16 or the hose connection tube 50 can now be removed again.

FIG. 4 shows that alternatively the faucet 16 or the connection tube 50 for a hose 52 can be fixed in the tube connection 14 in such a way that its longitudinal axis A is aligned with the longitudinal axis B of the tube end 48. In that connection position an annular rib 54 of the tube mouth end 48 bears against the outer flange collar 22 of the tube connection 14; a substantially radial retaining or detent rib 56 of a flexible pressure rocker member 58 then engages behind the flange collar 22. As shown in FIGS. 5 and 6, the rocker member 58 is formed on a radial limb 57 of the faucet 16 or the hose connection tube 50. Two radial limbs 57 for two pressure rocker members 58 are disposed in diametrically opposite relationship on the hose connection tube 50. Between the radial limbs 57 and a barb-like end collar 60 of the hose connection tube 50 for the hose 52, two annular ribs $\mathbf{54}_a$ formed thereon extend around it.

FIGS. 7 and 8 illustrate insertion and removal respectively of the hose connection tube 50 from the tube connection 14; arrows show the direction of movement in that respect.

The faucet 16 as shown in FIGS. 9 and 10 includes a downwardly directed outlet connection 62, in front of which a sealing disc 64 is disposed in the closed position; the sealing disc 64 is displaced towards the faucet grip 17 upon actuation of the faucet 16 to open the outlet connection 62 by means of an axial bar 66 formed thereon. The outlet connection 62 can also be provided with a hose 52.

FIGS. 11 and 13 show a fluid container 12 with a connected and a withdrawn faucet 16 while FIGS. 12 and 14 show the corresponding positions of the faucet 16 with the outer container 10 indicated.

What is claimed is:

1. A dispensing device, which comprises:

a fluid container having a wall thereof with an opening therein;

an outer container enclosing the fluid container and which is substantially stable in respect of shape;

a tubular portion of the dispensing device, which is in the form of a tube connection and which has a tube space therein having a cross-section thereof, and is liquid-tightly and gas-tightly connected to the wall of the fluid container in the region of the opening in the wall of the fluid container;

a connecting tube axially introduced into the tube space and having a tube mouth end, a tube wall and at least one radial opening of the tube wall adjacent the tube mouth end;

a separate closure body associated with the tubular portion and fitted on the tube mouth end, which in a closed position closes the cross-section of the tube space, and which is releasably fixed to the tube mouth end of the connecting tube, wherein said closure body is operative to be transferred with said connecting tube out of the closed position into an open position;

wherein said tube space of the tubular portion is a cylindrical tube space having container side and an opposed end and is larger on the container side than on the opposed end, and includes an annular shoulder; and wherein the closure body has a cylindrical ring which corresponds to the larger diameter of the tube space and whose axis in the closed position is on a longitudinal axis of the tubular portion and in the closed position bears against the annular shoulder.

2. A device according to claim 1, wherein the fluid container is of flexible material.

3. A device according to claim 1, wherein the tubular portion of the dispensing device is connected to the wall of the fluid container by means of a flange collar formed on the tubular portion.

4. A device according to claim 1, wherein the closure body is closed within its cylindrical ring, forming an annular groove, and the cross-sectional shape of the annular groove corresponds to that of the tube mouth end.

5. A device according to claim 4, wherein the width of the annular groove corresponds to the thickness of the tube wall of the tube mouth end.

6. A device according to claim 4, wherein adjoining the cylindrical ring at the inside surface thereof is a radial plate with a cup-like central outward enlargement portion, wherein the outside surface of the central enlargement portion is parallel to the axis of the tubular portion and delimits the annular groove at the inside thereof.

7. A device according to claim 6, wherein shaped ribs which are parallel to the axis of the tubular portion project from at least one of the outside surface of the central enlargement portion and the inside surface of the cylindrical ring.

8. A device according to claim 1, including an axial pin formed on one of the closure body and its cup-like central enlargement portion, wherein said axial pin projects into the tube space.

9. A device according to claim 8, including a transition portion of the axial pin which enlarges towards the central enlargement portion.

10. A device according to claim 1, wherein the closure body is formed from a plastic material which is harder than the material of the tubular portion.

11. A device according to claim 10, wherein the closure body is formed from polypropylene.

12. A device according to claim 1, wherein the tubular portion has a flange collar at each of its two ends.

13. A device according to claim 1, wherein an annular flange projects from the tubular portion at the receiving portion of the tubular portion for the closure body in the proximity of the annular shoulder.

14. A device according to claim 4, wherein said at least one radial opening in the tube wall of the connecting tube adjoins the clamping region thereof when the connecting tube is fitted in the annular groove.

15. A device according to claim 3, wherein the tube mouth end is provided with at least one pressure rocker member, which is disposed at a spacing relative to the outside surface of the tube mouth end and which is adapted to be tiltable relative thereto, and which is formed towards the free edge of the tube mouth end with a retaining rib which is directed approximately radially in a hook-like configuration relative to the longitudinal axis of the tube mouth end, wherein in the open position of a coupled pairing consisting of the tube mouth end and the tubular portion, a second flange collar of the tubular portion which is remote from the container has the retaining rib engaging said remote second flange collar.

16. A device according to claim 1, wherein the tube mouth end is part of a faucet including a locking device.

17. A device according to claim 1, wherein the tube mouth end is part of a faucet including a connection for a hose.

18. A device according to claim 16, including a tube portion which axially extends the tube mouth end, wherein the faucet has a lateral outlet connection and as a locking device an axially displaceable sealing disc which closes the cross-section thereof, and which is moved towards the container in the sealing position, and is returned into an outlet position by way of an axial bar.

* * * * *